United States Patent [19]

Tsuchie et al.

[11] Patent Number: 4,491,844

[45] Date of Patent: Jan. 1, 1985

[54] AUTOMOBILE ANTENNA WINDSHIELD

[75] Inventors: Masahiro Tsuchie; Tomihiko Takeoka; Takanobu Nomura, all of Hiroshima, Japan

[73] Assignee: Toyo Kogyo Co., Ltd., Hiroshima, Japan

[21] Appl. No.: 400,677

[22] Filed: Jul. 22, 1982

[30] Foreign Application Priority Data

Jul. 23, 1981 [JP] Japan ..... 56-116273

[51] Int. Cl.[3] ..... H01Q 1/32

[52] U.S. Cl. ..... 343/713; 343/704

[58] Field of Search ..... 343/713, 711, 704

[56] References Cited

U.S. PATENT DOCUMENTS 4,063,247 12/1977 Sakurai et al. ..... 343/713

4,155,090 5/1979 Kuroyanagi et al. ..... 343/713

FOREIGN PATENT DOCUMENTS 5724681 5/1982 Japan .

*Primary Examiner*—Eli Lieberman

*Assistant Examiner*—K. Ohralik

*Attorney, Agent, or Firm*—Fleit, Jacobson, Cohn & Price

[57] ABSTRACT

An automobile antenna device comprising a first antenna section provided on a windshield glass for receiving a first wave band, a power supply terminal connected with one end of the first antenna section, a grounding terminal connected with the other end of the first antenna section and having a grounding portion which is adapted to be connected with ground, an electric power source adapted to be connected with the power supply terminal lead so that defogging current be supplied to the first antenna section, a second antenna section provided on the windshield glass for receiving a second wave band, a connecting section having one end connected with the second antenna section and the other end connected with the grounding terminal lead at least in the vicinity of the grounding portion.

7 Claims, 5 Drawing Figures

AUTOMOBILE ANTENNA WINDSHIELD

The present invention relates to an antenna device for automobiles and more particularly to antenna means which is provided in a windshield glass and can also be used for heating the windshield glass for the purpose of defogging.

Hithertofore, it has been proposed and widely used to provide a radio antenna in a windshield. It has also been known to use windshield defogging heater elements as a radio antenna device. For example, in Japanese patent application No. 51-134285 filed on Nov. 9, 1976 and disclosed for public inspection under the disclosure No. 53 -59344 on May 29, 1978, there is described as prior art an automobile antenna device comprised of a first antenna section provided on a rear windshield glass of the automobile and intended for sensing a medium wave band and a second antenna section also provided on the rear windshield and intended for sensing a short wave or ultrashort wave band. The first and second antenna sections are connected together through a stub wire element constituting a trap circuit. The first antenna section includes a plurality of wire elements extending transversely across the rear windshield glass and connected at the opposite end portions with terminal lead sections which are connected through filter means with an electric power source so that the first antenna section can be used as a windshield defogging heater elements. The stub wire element connecting the first and second antenna sections is connected with one of the wire elements constituting the first antenna section at the intermediate portion thereof.

In this type of antenna device, it is intended that the filter means between the first antenna section and the electric power source function to eliminate noise components which are included in the heating current supplied from the power source to the first antenna section. However, in the arrangement as described in the aforementioned Japanese patent publication, it is unavoidable that a certain level of noise components be allowed to pass to the first antenna section resulting in unpleasant noises which are produced under influences of currents in the engine ignition system and the alternator. The Japanese patent application proposes to provide the filter means with two cores, one shows a high loss against a long wave band and the other shows a small loss against a long wave band. Such measures however has no effect in solving the aforementioned problems.

It is therefore an object of the present invention to provide an automobile antenna device in which noise components can be eliminated to a satisfactory lower level.

Another object of the present invention is to provide an automobile antenna device which can also be used as a windshield glass defogging device but can suppress noise to a satisfactory low level.

According to the present invention, the above and other objects can be accomplished by an automobile antenna device comprising a first antenna section provided on a windshield glass for receiving a first wave band, power supply terminal means connected with one end of said first antenna section, grounding terminal means connecting with the other end of the first antenna section and having a grounding portion which is adapted to be connected with ground, means for connecting electric power source to said power supply terminal lead means so that defogging current be supplied to the first antenna section, a second antenna section provided on the windshield glass for receiving a second wave band, a connecting section having one end connected with said second antenna section and the other end connected with said grounding terminal lead means at least in the vincinity of said grounding portion. The present invention is based on the findings that the noise components show the lowest level in the grounding terminal lead means, particularly at the grounding portion, when the defogging current is being supplied to the first antenna section, and proposed to connect the first antenna section with the second antenna section at or in the vincinity of the grounding portion of the grounding terminal means.

The first antenna section may include a plurality of wire elements extending transversely across the windshield glass and the power supply and grounding terminal means may be comprised of a pair of conductive leads extending respectively along opposite side edge portions of the windshield glass and respectively connected with opposite ends of the wire elements. In such an arrangement, the grounding portion of the grounding terminal means may be constituted by a lug portion formed in an intermediate portion, preferably at the longitudinal center portion of the conductive lead. It is preferred that the connecting section has a junction to the grounding terminal means at the lug portion, however, satisfactory results can also be obtained even when the junction is displaced to a certain extent from the lug portion. It should however be noted that if the junction between the connecting section and the grounding terminal means is located too far from the grounding or lug portion, it is very likely that a ripple noise be produced due to low frequency noise components which may be generated in the alternator. Preferably, the junction should be located as measured from the grounding portion within 10% of the distance from the grounding portion to each end of the conductive lead but a satisfactory result can be obtained by locating the junction within 15% of the said distance.

In a preferable arrangement, the first antenna section is designed for receiving a medium frequency AM broadcast whereas the second antenna section is designed for a high frequency FM broadcast connected with a radio unit. In this arrangement, the connecting section constitutes a reactance circuit so that the high frequency signal as received by the second antenna section be transmitted without any significant loss to the radio unit while the medium frequency signal as received by the first antenna section be transmitted through the connecting section and the second antenna section.

The above and other objects and features of the present invention will become apparent from the following descriptions of a preferred embodiment taking reference to the accompanying drawings, in which.

Figure 1:
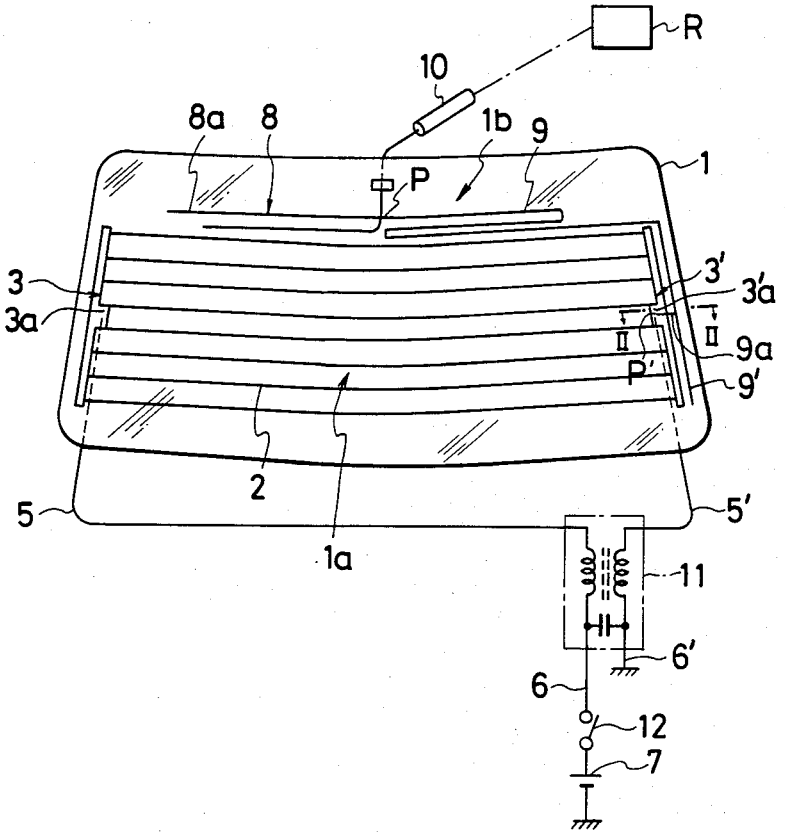
FIG. 1 is a view of an automobile rear windshield glass having an antenna device in accordance with one embodiment of the present invention.
Figure 2:
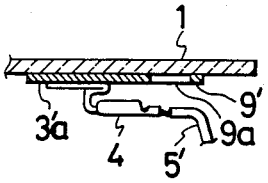
FIG. 2 is a fragmentary sectional view taken substantially along the line II—II in FIG. 1.

Referring to the drawings, particularly to FIGS. 1 and 2, there is shown an automobile rear windshield glass 1 having a substantially trapezoidal configuration. On the windshield glass 1, there are provided a plurality of substantially parallel conductive wire elements 2 which are extending transversely substantially across the windshield glass 1 to thereby cover a heating zone 1*a* on the glass 1. Along the opposite side edge portions of the glass 1, there are a pair of conductive terminals 3 and 3' which are of elongated configurations having widths larger than the widths of the wire elements 2 and respectively connected with opposite ends of the wire elements 2. The terminal 3 constitutes a power supply terminal whereas the terminal 3' a grounding terminal. The terminals 3 and 3' have lug portions 3*a* and 3*a*', respectively which extend in a transverse inward direction of the glass 1. The lug portion 3*a* is connected through a wire 5 and a noise filter 11 with a power supply line 6 which in turn is connected through a defogger control switch 12 with an electric power source 7. The lug portion 3*a*' is connected through a wire 5' and the noise filter 11 with a grounding line 6. As shown in FIG. 2, the lug portion 3*a*' is attached with a connector 4 which is fitted to one end of the wire 5'. The wire elements 2 constitute a first antenna section for receiving a medium and/or low frequency AM bands.

Above the heating zone 1*a* where the aforementioned wire elements 2 are provided, the windshield glass 1 further has a further zone 1*b* which carries a second antenna section 8*a* including a plurality of wires 8 which are connected together at a junction P. In this embodiment, the second antenna section 8 is designed for receiving a high frequency FM wave band. The junction P is connected with a feeder 10 which leads to a radio unit R. A connecting section 9 is provided for connecting the first and second antenna sections together. In the illustrated embodiment, the connecting section 9 constitutes a portion of a stub of the second antenna as well as a reactance circuit so that the FM mode short wave as received by the second antenna section 8 can be transmitted to the radio unit R without any noticeable loss, whereas the AM mode medium of long wave as received by the first antenna section can be transmitted through the connecting section 9 and the feeder 10. The AM mode wave as received by the second antenna section is also transmitted through the feeder 10 to the radio unit.

The connecting section 9 is connected at one end with the junction P of the second antenna section 8. The other end portion 9' of the connecting section 9 extends substantially along the grounding terminal 3' as shown in FIG. 1 and connected at an intermediate portion thereof with the grounding terminal 3' through a transversely extending lead 9*a*. In the illustrated embodiment, the lug portion 3*a*' is formed at the longitudinal center portion of the grounding terminal 3' and the junction P' between the grounding terminal 3' and the end portion 9' of the connecting section 9 is provided in the area where the lug portion 3*a*' is formed. A satisfactory result can however be obtained even when the junction P' is displaced from the lug portion 3*a*' as long as the displacement is within 15% of the distance between the lug portion 3*a*' and the adjacent end of the grounding terminal 3'.

In the antenna device as described above, when the defogger control switch 12 is closed and the wire elements 2 are supplied with electric current, the noise filter 11 functions to block noise components contained in the current, but low frequency noise components may be allowed to pass through the noise filter 11. However, since the noise level is lower in the grounding terminal 3' than in the wire elements 2 and the power supply terminal 3, more particularly, since the noise level decreases significantly in the vicinity of the grounding lug portion 3*a*' and where the grounding lug portion 3*a*' is provided at the longitudinal center portion of the grounding terminal 3', the noise level is minimized, and it is possible to prevent the low frequency noise components, such as ripple noise components as produced in the alternator, from being passed through the connecting section 9 and the feeder 10 to the radio unit R. It is therefore possible to increase the S/N ratio to a remarkable extent.

Figure 3:
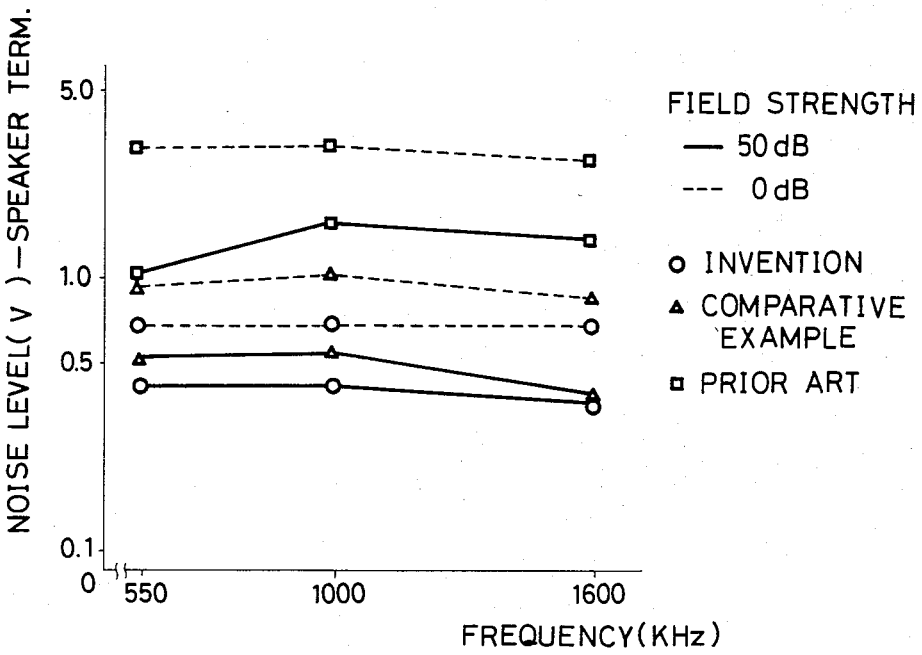
FIG. 3 is a diagram showing the noise level at the radio speaker terminal.

FIG. 3 shows the noise level at the radio speaker terminal in relation to the frequency of the received wave. In the test data shown in FIG. 3, the data for the present invention has been obtained by the aforementioned arrangement wherein the junction P' between the connecting section 9 and the grounding terminal 3' is located in an area where the lug portion 3*a*' is formed. The data for the comparative example is based on an arrangement wherein the connecting section is attached to one end of the grounding terminal. The prior art is based on the arrangement as shown in FIG. 1 of the aforementioned Japanese patent application. It will be noted in FIG. 3 that according to the present invention the noise level can be significantly decreased.

Figure 4:
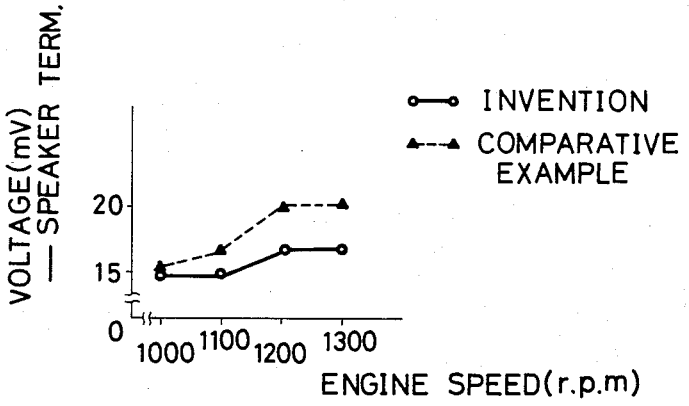
FIG. 4 is a diagram showing the electric voltage at the radio speaker terminal; and, FIG. 5 is a diagram showing the noise level on a time scale.

In FIG. 4, there are shown the changes in the speaker terminal voltage in response to changes in the engine speed. It will be noted that in the comparative example the speaker terminal voltage noticeably increases as the engine speed increases. It is understood that this is caused by an increase in the low frequency noise components. As contrast to this, according to the present invention, there is no remarkable increase in the speaker terminal voltage even when the engine speed is increased. Thus, it will be understood from FIG. 4 that the low frequency noise level can be significantly decreased.

Figure 5:
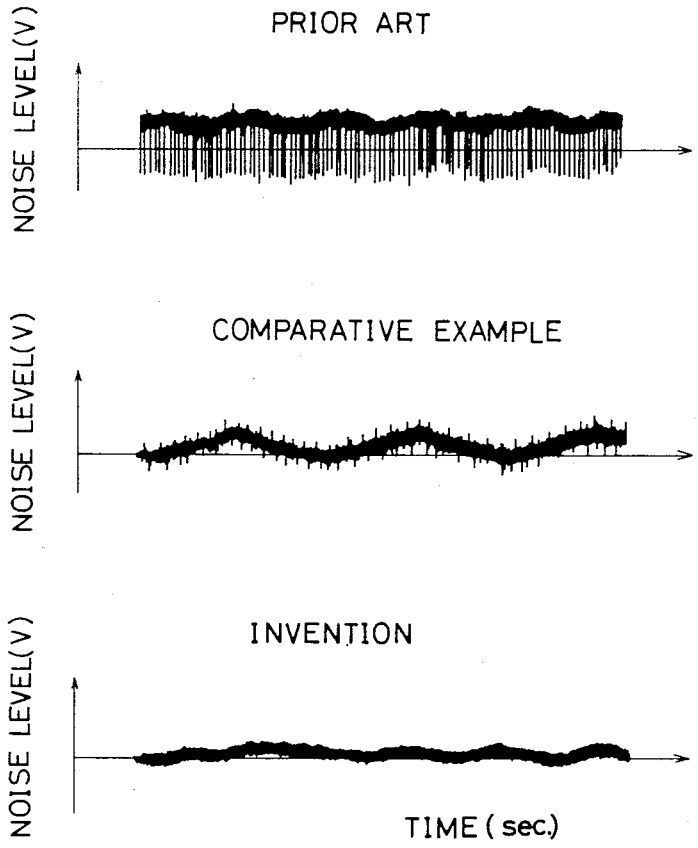

FIG. 5 shows the noise level on a time scale with the engine in an idling operation. It will be noted that in the comparative example there still remains a ripple noise whereas in the present invention such a ripple noise can be substantially eliminated.

The invention has thus been shown and described with reference to a specific embodiment, however, it should be noted that the invention is in no way limited to the details of the illustrated arrangements but changes and modifications may be made without departing from the scope of the appended claims.

We claim:

1. An automobile antenna device comprising a first antenna section provided on a windshield glass for receiving an AM mode wave band, power supply terminal means connected with one end of said first antenna section,grounding terminal means connected with the other end of the first antenna section and having a grounding lug portion which is adapted to be connected with ground, means for connecting an electric power source to said power supply terminal means so that defogging current is supplied to the first antenna section, a second antenna section provided on the windshield glass for receiving an FM mode wave band, a connecting section having one end connected with said second antenna section and the other end connected with said grounding terminal means at least in the vicinity of said grounding lug portion, said connecting section constituting a part of a stub portion of said second antenna section as well as a reactance circuit, said first antenna section including a plurality of wire elements extending transversely substantially across the windshield glass, said power supply terminal means including an elongated terminal connected with one of the ends of said wire elements, said grounding terminal means including an elongated terminal connected with the other of the ends of said wire elements, said elongated terminals extending substantially along opposite side edge portions of the windshield glass, said terminal constituting the grounding terminal means being of a substantially uniform width and formed with said grounding lug portion.

2. An antenna device in accordance with claim 1 in which said connecting section is connected with said grounding terminal means at an area where said lug portion is formed.

3. An antenna device in accordance with claim 1 in which said lug portion is formed at a longitudinal center portion of the grounding terminal means.

4. An antenna device in accordance with claim 1 in which said connecting section includes an end portion extending substantially parallel with and connected to said terminal constituting the grounding terminal means.

5. An antenna device in accordance with claim 1 in which said connecting section is connected with the grounding terminal means through a junction located within 15% of the distance between the grounding portion on the grounding terminal means and each end of said grounding terminal means as measured from said grounding portion.

6. An antenna device in accordance with claim 4 in which said grounding portion is provided at a longitudinal center portion of the grounding terminal section and connected with said end portion of the connecting section through a transversely extending lead.

7. An antenna device in accordance with claim 1 in which said connecting section is connected with said grounding terminal means at an area where said grounding lug portion is formed, said lug portion being formed at substantially the longitudinal center portion of the grounding terminal means, said connecting section including an end portion extending substantially parallel with and connected to said terminal constituting the ground terminal means, said grounding lug portion being provided at a longitudinal center portion of the grounding terminal section and connected with said end portion of the connecting section through a transversely extending lead.

* * * * *